US007799206B2

(12) United States Patent
Van Den Berg et al.

(10) Patent No.: US 7,799,206 B2
(45) Date of Patent: Sep. 21, 2010

(54) METHOD OF PRODUCING A PIPELINEABLE BLEND FROM A HEAVY RESIDUE OF A HYDROCONVERSION PROCESS

(75) Inventors: Franciscus Gondulfus Antonius Van Den Berg, Amsterdam (NL); Scott John Fryer, Calgary (CA); Marshall Glenn Letts, Corunna (CA); Michael Robert Margerum, Calgary (CA); William James Power, Calgary (CA); Oscar Kui Yin Sy, Calgary (CA); Larry Vadori, Calgary (CA)

(73) Assignee: Shell Oil Company, Houston, TX (US)

( * ) Notice: Subject to any disclaimer, the term of this patent is extended or adjusted under 35 U.S.C. 154(b) by 808 days.

(21) Appl. No.: 10/555,881

(22) PCT Filed: May 7, 2004

(86) PCT No.: PCT/EP2004/050733

§ 371 (c)(1),
(2), (4) Date: Aug. 1, 2006

(87) PCT Pub. No.: WO2004/099349

PCT Pub. Date: Nov. 18, 2004

(65) Prior Publication Data

US 2007/0023323 A1 Feb. 1, 2007

(30) Foreign Application Priority Data

May 9, 2003 (CA) ..... 2428369

(51) Int. Cl.
*H01B 3/22* (2006.01)

(52) U.S. Cl. ..... 208/14; 208/108; 208/109; 208/110

(58) Field of Classification Search ..... 208/14, 208/108–110
See application file for complete search history.

(56) References Cited

U.S. PATENT DOCUMENTS

| | | | | |
|---|---|---|---|---|
| 4,411,768 | A * | 10/1983 | Unger et al. | 208/59 |
| 4,728,412 | A | 3/1988 | Soderberg | 208/22 |
| 5,320,741 | A * | 6/1994 | Johnson et al. | 208/49 |
| 5,807,478 | A | 9/1998 | Myers | 208/370 |
| 5,871,634 | A * | 2/1999 | Wiehe et al. | 208/48 R |
| 6,096,192 | A | 8/2000 | Myers et al. | 208/108 |
| 6,355,159 | B1 | 3/2002 | Myers et al. | 208/108 |

FOREIGN PATENT DOCUMENTS

CA 2354734 2/2002

OTHER PUBLICATIONS

Speight, J. G. (1999). The Chemistry and Technology of Petroleum, 3rd ed. Marcel-Dekker, 918 pgs. (Office action cited p. 418).*

(Continued)

*Primary Examiner*—Robert J Hill, Jr.
*Assistant Examiner*—Brian McCaig

(57) ABSTRACT

A method is disclosed for producing a stable pipelineable blend from a heavy residue of a catalytic hydroconversion process operating at high (60-80%) conversion rate by blending the heavy residue with a virgin bitumen, such as a bitumen produced from the Peace River or Cold Lake oil sand deposits in Alberta, Canada, and/or with a Wabasca virgin heavy crude oil wherein the 524° C.+ Fraction of the blend is controlled such that: 1) The blend comprises less than 40 vol % of heavy 524° C.+ components, i.e. components which boil at atmospheric pressure at a temperature above about 524 Degrees Celsius; and 2) The 524° C.+ fraction in the blend comprises less than about 80 vol % of heavy residue originating from the hydroconversion process.

8 Claims, 2 Drawing Sheets

OTHER PUBLICATIONS

International Search Report dated Jul. 29, 2004.

Fouling of Nearly Incompatible Oils at the Symposium on Heavy Oil and Resid Compatibility and Stability, organized by the Division of Petroleum Chemistry at the 221st National Meeting of the American Chemical Society, San Diego, California, Apr. 1-5, 2001.

Developments in Oil Blending presented by F.G.A. van den Berg at the 7th Intl Conf. On Stability and Handling of Liquid Fuels in Graz, Austria, Sep. 2000 (IASH-2000).

L.J. Wachel titled: Exchange Simulator:Guide to Less Fouling in the Nov. 1996 Issue of the magazine Hydrocarbon Processing, pp. 107-110.

* cited by examiner

METHOD OF PRODUCING A PIPELINEABLE BLEND FROM A HEAVY RESIDUE OF A HYDROCONVERSION PROCESS

PRIORITY CLAIM

The present application claims priority on Canadian Patent Application 2,428,369 filed 9 May 2003.

FIELD OF THE INVENTION

The invention relates to a method of producing a pipelineable blend from a heavy residue of a hydroconversion process and to a blend produced by the method.

BACKGROUND OF THE INVENTION

In recent years, there has been increasing activity and interest in upgrading to saleable crudes the vast reserves of Canadian oil sands and in-situ bitumen in Northern Alberta. Both minimum upgrading (by just diluting bitumen with condensate for pipelining) and maximum upgrading (using refinery upgrading processes that are complex and expensive) have been considered in different projects. When selecting residue upgrading processes, carbon rejection and hydrogen addition routes can be selected in various refinery settings for different reasons. Coking, deasphalting, thermal cracking and gasification are examples of carbon rejection routes. LC-Fining and H-Oil are examples of hydrogen addition routes.

Various technical, economic and environmental factors impact the decision to select an appropriate process for upgrading bitumen and unconverted hydrocarbon residues. For example, a coking option will create coke that will have to either be stockpiled or transported to market. A gasification option will have to address the environmental problem of carbon dioxide emissions. An LC-Fining option will manufacture unconverted residues that need to be transported to the end-users.

In the case of hydrogen addition routes or "hydroconversion" processes, such as LC-Fining and H-Oil, are most economical when running at high conversion rates. However, conversion rates are currently limited by the inability to make stable products with the unconverted residues and transport them to the market. If the unconverted residues need to be transported over long distances to the market, large amounts of diluent are required to meet pipeline density and viscosity requirements. However, this mixing with large quantities of diluent can in turn destabilize asphaltenes contained in the unconverted residues, which can cause them to precipitate and foul tanks, pipelines, and any equipment employed by end-users.

Canadian patent application 2354734 and U.S. Pat. No. 6,355,159 disclose a method for dissolution and stabilization of thermally converted bitumen from "mild-hydroconversion" process (partial upgrading at 40%-60% conversion of the residue defined as 525° C.+ fraction) by adding back the diluent modified bitumen itself. This allowed for a reduction in the amount of naphtha and natural gas condensate required for rendering the bitumen suitable for pipelining from production sites to refining centers. However, this method does not address the different types of unconverted residues generated from higher conversion hydroconversion processes such as LC-Fining or H-oil (60-80% conversion of residue). These commercial processes are different in configuration and catalyst type from the "mild-hydroconversion" process and create a much more severe asphaltene instability and incompatibility problem. Also, these processes are usually located at major refining centres, where a special "diluent modified bitumen or diluent modified heavy hydrocarbon" is normally not available. Most heavy crudes or diluted bitumen arrive as is at pipeline terminals as saleable materials meeting pipeline specifications. Any change to the composition would be at additional cost. Although the concept of toluene equivalency number was investigated in the above Canadian patent, the issue of fouling at end-users has not been addressed.

Thus, there is a need for a method to produce pipelineable crudes from unconverted residues that will be stable in the pipeline system and will not cause excessive fouling at end-users. This is the subject of the current invention. This method will solve the instability and incompatibility problem associated with hydroconversion at higher rates of conversion than mild hydroconversion and will debottleneck by allowing residue upgrading processes to operate at higher rates of conversion, for better economics.

SUMMARY OF THE INVENTION

In accordance with the invention there is provided a method of blending a heavy hydrocarbon residue from a residue hydroconversion process into a pipelineable blend, the method comprising blending the heavy hydrocarbon residue with a virgin bitumen diluted with a diluent and/or a virgin heavy crude oil such that in the produced blend the amount of heavy hydrocarbon residue originating from said residue hydroconversion process is maintained below a predetermined maximum value wherein the heavy hydrocarbon residue stems from a high conversion catalytic hydroconversion process, operating at a 60-80% conversion rate of the 524° C.+ fraction and that the blending comprises controlling the composition of the heavy 524° C.+ component in the blend such that the blend comprises less than 40 vol % of heavy 524° C.+ components, which boil at atmospheric pressure at a temperature above about 524 Degrees Celsius and that the ratio between the unconverted heavy 524° C.+ components contained in the heavy hydrocarbon residue and the virgin 524° C.+ components contained in the virgin bitumen diluted with diluent and/or virgin heavy crude oil is such that the heavy 524° C.+ components in the blend comprise less than 80 vol % unconverted heavy 524° C.+ hydrocarbon residue originating from the residue hydroconversion process.

It is preferred that the blending step comprises controlling the heavy 524° C.+ components in the blend such that the blend comprises less than 40 vol % of heavy 524° C.+ components, more in particular it is preferred that the heavy 524° C.+ component content of the blend is controlled such that the blend comprises between 30 and 36 vol % of heavy 524° C.+ component.

When used in this specification and claims the term 524° C.+ component means the component that boils at atmospheric pressure at a temperature above about 524 Degrees Celsius.

Furthermore it is preferred that the blending step comprises controlling the ratio between the heavy 524° C.+ component contained in the heavy hydrocarbon residue and the virgin heavy 524° C.+ component contained in the virgin bitumen diluted with diluent and/or virgin heavy crude oil such that the heavy 524° C.+ component in the blend comprises less than 80 vol % heavy 524° C.+ hydrocarbon residue originating from the residue hydroconversion process.

More in particular it is preferred that the heavy 524° C.+ component in the blend comprises between 45 vol % and 75 vol % unconverted heavy 524° C.+ hydrocarbon residue originating from the residue hydroconversion process.

In case a virgin bitumen is used as a blending agent it is preferred that the virgin bitumen is diluted with a hydrocarbon condensate as diluent. Suitable virgin bitumens are bitumens originating from the Peace River, and/or Cold Lake oil sand deposits in Canada.

The blend ratio between the unconverted heavy hydrocarbon residue and the virgin bitumen diluted with a diluent and/or virgin crude oil may be determined on the basis of test protocols known as ASTM hot filtration test, a P-Value test and a fouling test.

In such case it is preferred that the blend ratio is determined such that the blend has in the ASTM hot filtration test a HFT<0.15 wt and in the P-Value test a P-Value>1. The P-Value is the measured ratio between the peptizing power, or available aromaticity, and the flocculation ratio, which is the aromaticity required to keep the asphaltenes in solution. The F-value test is described in the paper 'Developments in oil blending' presented by F. G. A. van den Berg at the 7th International Conference on Stability and Handling of Liquid Fuels in Graz, Austria, 24-29 Sep. 2000 (IASH-2000)

The method according to the invention may be used to produce stable blends with stabilized asphaltenes that are transportable through long distance onshore or offshore pipelines having a length more than 100 kilometers or even more than 1000 kilometers, in cold climates where the temperature outside the pipeline may be well below 0 Degrees Celsius or even below −30 Degrees Celsius.

The heavy hydrocarbon residue used in the method according to the present invention may stem from a high conversion catalytic hydroconversion process, such as processes known as LC-Fining or H-oil (HRI), operating at a 60-80% conversion rate. In order to reduce the volume percentage amount of virgin bitumen and/or virgin crude oil required to obtain a pipelineable blend the blend may comprise up to 5 vol % of SR bypass of an LC-Fining feed.

Accordingly the method according to the invention is directed to the use of commercially available heavy oil or diluted bitumen at major refining centers to stabilize the asphaltenes from the unconverted heavy residues. Suitability of potential heavy oils or bitumens for any given type of unconverted residue may be determined using the above HFT, P-Value and fouling testing protocols. The testing protocols determine whether given heavy oils or bitumens have the "stability reserve" and "fouling suppressant" characteristics required to stabilize asphaltenes in a given unconverted residue. The protocols may consist of a series of tests to determine properties such as Hot Filtration (target <0.15% wt), P-value (target >1) as well as fouling tests.

To solve the instability and incompatibility problem, in a preferred embodiment of the invention approximately 1 volume of a conventional pipelineable heavy oil or commercial diluted bitumen (thermal in-situ produced) may be used, to mix with approximately 1-2.5 volumes of a "heavy mix of materials" from the residue hydroconversion process. This "heavy mix of materials" from an catalytic hydroconversion upgrader unit is a mixture containing 30-40% unconverted residues with the rest being hydrotreated or unhydrotreated light oils. The 524° C.+ content in the resultant final heavy crude blend should preferably be in the range of 30-36 vol %. The volume ratio required of conventional heavy oil/diluted bitumen to upgrader "heavy mix of materials" may vary depending on the effectiveness/origin of the heavy oils or diluted bitumens, the conversion level in the residue hydroconversion process, and the light oil diluent being hydrotreated or unhydrotreated. The resultant final heavy crude blend is a pipelineable heavy crude such that a significant fraction of the heavy 524° C.+ component (defined as 524° C.+ fraction), preferably 25-55 vol % of the 524° C.+ fraction is of "natural origin" or "virgin" residue (i.e., uncracked residue from the conventional heavy oils or diluted bitumens used). If some internal vacuum residue can be bypassed directly to blending (no more than 5% vol in the resultant final heavy crude blend), the volume of conventional heavy oils or diluted bitumens as blending component can be reduced as long as the equivalent same % of virgin 524° C.+ is kept.

The invention also relates to a stable pipelineable blend, which is obtainable by the method according to the invention. The pipelineable blend comprises an amount of heavy components below a predetermined maximum value and an amount of unconverted heavy hydrocarbon residue originating from said residue hydroconversion process contained in said heavy components below a predetermined maximum value. Preferably the blend comprises less than 40 vol % of heavy 524° C.+ components and said heavy 524° C.+ components comprise less than 80 Vol % of heavy 524° C.+ hydrocarbon residue originating from a hydroconversion process.

These and other features, advantages and embodiments of the method according to the invention will be apparent from the following examples, claims, abstract and detailed description in which reference is made to the accompanying Figures.

BRIEF DESCRIPTION OF THE FIGURES

The invention will be described in more detail and by way of example with reference to the accompanying Figures in which.

DETAILED DESCRIPTION OF THE INVENTION

Figure 1:
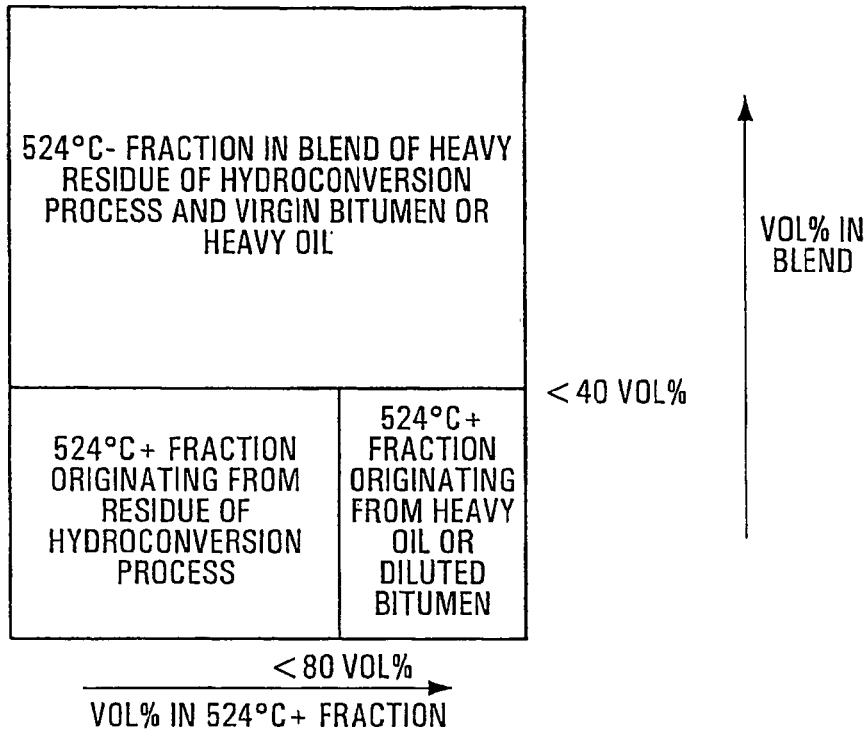
FIG. 1 is a schematic representation of the composition of a pipelineable blend produced in accordance with the invention, comprising <40 Vol % of 524° C.+ Fraction and wherein the 524° C.+ Fraction comprises <80 Vol % of heavy residue of a hydroconversion process.

FIG. 1 illustrates that a stable pipelineable blend may be produced from a heavy residue of a hydroconversion process by blending the heavy residue with a virgin bitumen, such as a bitumen produced from the Peace River or Cold Lake oil sand deposits in Alberta, Canada, and/or with a virgin heavy crude oil, such as a heavy crude produced from the Wabasca heavy oil deposit by controlling the 524° C.+ Fraction of the blend such that:

1. The blend comprises less than 40 Vol % of 524° C.+ components, i.e. components which boil at atmospheric pressure at a temperature above about 524 Degrees Celsius; and 2. The 524° C.+ fraction in the blend comprises less than 80 vol % of heavy residue from the hydroconversion process.

The present invention applies to heavy oils or bitumens subjected to a "high conversion" catalytic residue hydroconversion process.

The term "high conversion" is used for referring to a catalytic residue hydroconversion process, licensed by ABB Lummus Global (LC-Fining) or HRI (H-Oil), conducted in the presence of hydrogen, in which about 60%-85% of the 524° C.+ fraction is converted to products of lower viscosity and density. Preferably the high conversion residue hydroconversion process is conducted at temperatures ranging from 400° C. to 450° C., at hydrogen partial pressures ranging from 1500 psig to 2500 psig, and at liquid hourly space velocity ranging from 0.1 to 0.5 L/L/hr. A catalyst (either single or multiple system) is normally used and ebullated in the reactors of the residue hydroconversion process. Such catalyst is commercially available from catalyst suppliers such as Criterion and Grace. Typically the catalyst is added intermittently to the process and also withdrawn at a rate of about 1-5% daily of the inventory in the reactors.

As an example of a "high conversion" hydroconversion process configuration, diluted bitumen is processed first in an atmospheric and vacuum unit to recover the diluent, naphthas, gasoils and vacuum gasoils for downstream hydrotreating. The vacuum residue (defined nominally as 524° C.+ fraction) is sent to a set of LC-Fining reactors where it is converted under high temperature, high pressure of H2 and catalyst to light oil products. The reactor effluent is usually separated into light and heavy oil streams (some units have a vacuum tower as well). The light oils and vacuum gasoils are hydrotreated further downstream to produce residue-free synthetic crudes. If there is no coker on-site nor nearby fuel oil market, the heavy oil (containing the unconverted residues) has to be sent for blending into pipelineable heavy crudes by adding back some light oils as diluent. The current industry pipeline specifications for heavy crudes are:

Density at 15° C.: maximum 940 Kg/$m^3$

Viscosity at 6° C.: maximum 350 cSt in winter months

BS&W <0.5% v

Figure 2:
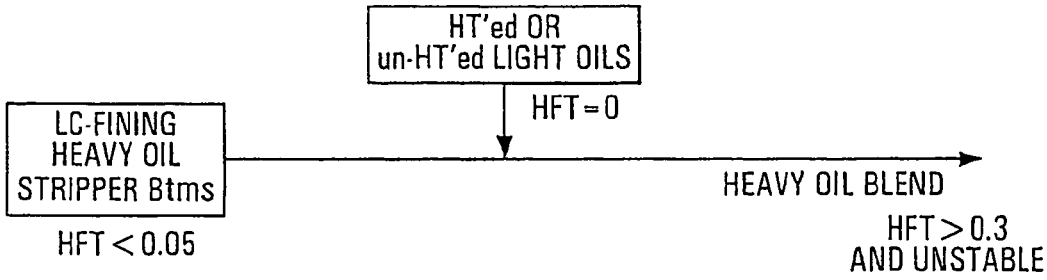
FIG. 2 illustrates how particles will form in an unstable blend of incompatible components which do not have a significant HFT by themselves into a blend having a high HFT, thereby forming an unpipelineable blend in which asphaltene precipitation will occur.

However, these bulk properties do not describe the challenge of making stable heavy crude blends. The definition of instability and incompatibility can be described as "when particles form as a result of blending light and heavy oils together". This is illustrated in FIG. 2, when blending of components which each by themselves did not have significant HFT, would result in a blend has that a high HFT. Although there is no acceptable industry standard for characterizing instability and incompatibility, some learning from heavy fuel oil from thermal cracker residue blending can be adopted here and a sign of instability is usually evident when:

P-value <1

ASTM HFT of blend >>ASTM HFT of individual components

The "P-value" technique is disclosed in the earlier described IASH-2000 paper and is a method to measure the peptizing power of an oil sample to keep the asphaltenes in solution against the flocculation tendency of asphaltenes in this oil to destabilize the asphaltenes. It was developed initially to characterize and allow the calculation/prediction of the stability of fuel oils and more recently has been used to assess incompatible crude mixes. There is a similar but not equivalent method by Wiehe called solubility blending number and insolubility number, as described in a paper presented by I. A. Wiehe titled "Fouling of Nearly Incompatible Oils" at the Symposium on Heavy Oil and Resid Compatibility and Stability, organised by the Division of Petroleum Chemical Society, San Diego, Calif., Apr. 1-5, 2001. The two methods differ in the solvents and procedures used. For unstable oils where asphaltenes precipitate out, the P-value is less than 1 according to the P-Value determination method.

The ASTM HFT and P-value determination methods only address the transportation and storage aspects of the heavy crudes but not the processing aspects of these crudes in customer refinery crude exchangers and heaters. Thus the definition of stable heavy crudes need to be expanded to include evaluation of fouling characteristics in heat exchangers and heaters such that "unstable" crudes would also mean in addition to HFT and P-value:

Fouling more than conventional crudes

The reason for this additional criterion is that fouling characteristics for hydroconversion materials cannot be easily correlated with HFT nor P-value.

For economic reasons, residue hydroconversion processes are always pushed to the limit of either reactor stability or stability of product blending downstream. At high conversion, the mixture of unconverted residues (still containing much asphaltenes) and hydrotreated light oils do not have much "inherent stability reserve" left. So often, stability of this heavy mix of materials is borderline, if not unstable already. Thus, prior to this invention, no commercial units have been able to blend up stable heavy crudes to put into the pipelines with unconverted residues.

When surveying current light, medium and heavy crudes for ASTM HFT and P-value, it is evident that conventional and heavy crudes have low HFT and P-value>1, see Table 1.

TABLE 1

Survey of Canadian Conventional and Heavy Crudes

| Crudes | Density | HFT | P-value |
|---|---|---|---|
| MSW | 0.830 | 0.01-0.08 | 1.39-1.81 |
| LSB | 0.853 | <0.01 | 1.20 |
| SLE | 0.846 | 0.01 | 1.80 |
| SHE | 0.849 | 0.01 | 2.12 |
| Midale | 0.898 | 0.01-0.03 | 1.62-1.77 |
| Bow | 0.934 | <0.01 | 2.56 |
| Cold Lake Blend | 0.927 | 0.01-0.03 | 2.05 |
| Peace River Blend | 0.933 | 0.01 | 2.05-2.42 |
| Wabasca | 0.935 | <0.01 | 2.79 |
| Lloyd Blend | 0.936 | 0.01 | 2.58 |

Also, these crudes have been processed in existing refineries and any fouling is manageable with current means. This implies that some residues of the conventional crudes, particularly the heavy crudes, possess "stability reserve" which the present invention can exploit. Thus this invention's idea is to use a commercially available conventional crude as a blending component to improve the HFT and P-value of a otherwise borderline (or even failed) stability heavy crude blend from an upgrader. However, not all residues have the same "stability reserve" characteristics. Light and medium crudes residues tend to be not as aromatic and are usually not good candidates for blending components. Thus, the heavy crude residues are more suitable candidates.

Also, since this blending component is a pipelineable heavy crude (meeting already viscosity and density specification), no additional light oils for diluent from the upgrader would be required.

The implication on hydroconversion processes is significant with the present invention. Not only could the limitation of proximity requirement of unconverted residue end-users (coker, gasifier, fuel oil market) be removed, but also conversion can be pushed upwards to improve residue upgrading economics.

The selection process for the right candidate of a commercially available heavy crude as a blending component for the upgrader heavy mix of unconverted residues and light oils is described below.

Quality Targets and Testing Protocol

In order to guide the understanding of the crude blend stability behaviour in the testing program and the search for a solution, the current invention adopted the following key quality targets and testing protocol for ensuring production of stable pipelineable crudes from unconverted residues of upgrader:

Hot Filtration Test (ASTM D4870—existent) <0.15% wt.

Automated P-value (Shell Method) >1

Fouling tests results: to be among benchmark crudes

It should be noted that none of the above tests are yet pipeline specifications. The HFT <0.15% wt and P-value >1 are based on in-house experience with fuel oils and crude mixes. The P-value is an in-house Shell method. There is a similar technique by Wiehe but the definition of P-value >1 would need to be translated accordingly based on similar database required for crudes and fuel oils. The fouling tests are described further later.

(a) Blending Protocol

In the laboratory blending tests, it was observed that the order in which the components are put together, is very important to ensure that instability does not occur prematurely due to incompatibility of some components in relative amount. This will affect the outcome of the quality of the blend. Thus, the guiding principle for checking the design of a blending system is: "components should be added in order of heaviness (as expressed in density, viscosity, boiling range and aromatic nature), heaviest ones should be put together first and lightest ones last". This will help maintain asphaltene solubility/stability in the final heavy crude blend. The following order is recommended:

start with a heavy oil sample from reactor effluent separators (stripper or vacuum unit);

only if applicable, add some virgin vacuum residue bypass;

add commercially available blending components: diluted bitumens or heavy oils; and add light oil components in the order of highest to lowest aromaticity and density.

(b) Fouling Tests Protocol

The fouling tests were carried out using a standard ALCOR fouling rig. The basic concept of running this test is to pass a fluid sample through a resistance-heated tube-in-shell heat exchanger, while monitoring flow, temperature and pressure. The sample rises vertically in the annular space between the heater tube and its outer stainless steel housing. A low voltage, high current AC signal is passed through the heater tube to provide resistance heating. A temperature controller is used to control the heater tube temperature. The resultant temperature profiles and the associated inlet and outlet temperatures are used to obtain the fouling factor, which is the percentage change in the calculated heat transfer coefficient. This equipment has been used extensively in-house in the past to evaluate fouling of crudes. This type of testing has also been used elsewhere in the industry and is described in an article written by L. J. Wachel titled "Exchange Simulator: Guide to Less Fouling" in the November 1996 issue of the magazine Hydrocarbon Processing, pages 107-110. It is an accelerated exchanger fouling simulation as the liquid velocity is rather low (~0.0014 m/s) compared to commercial velocity (1-2 m/s). In addition, due to the severity of the test the delta temperature between tube skin temperature and bulk fluid temperature is usually large ~100-200° C. (for 250-400° C. tube temperature) compared to 50-60° C. usually allowed in commercial heat exchangers to minimize fouling. However, the accelerated tests do allow measurement of fouling within a short period of time for laboratory experiments. Thus, the test results could be used for comparative purpose against benchmark.

The fouling tests used in this invention are "sequential temperatures" fouling tests. This is intended to simulate the sequential fouling of an oil sample first in the preheat section of the atmospheric distillation tower and then in the crude heater. Each oil sample is subjected to two fouling temperatures. In the first run, the test sample was subjected to a 250° C. tube temperature setting on a fresh tube. At the end of the first test, the resultant liquid was recovered for the next experiment in which it is subjected to a 400° C. tube temperature setting using again a fresh tube. The initial liquid outlet temperature for each run is reported together with the percentage of fouling at each temperature.

To establish first a database of benchmark crudes, a large number of conventional light and heavy crudes were used in the test program for checking their sequential temperature fouling behaviour in the ALCOR rig. These crudes are sampled at various pipeline terminals (Edmonton, Hardisty, Cromer, and Kerrobert). The heavy crudes were sampled at the end of the summer, thus viscosity may be slightly higher than 350 cSt at 6° C.:

Light crudes tested: Brent and Husky Synthetic Blend

Medium crudes tested: LSB, SLE, Midale

Figure 3:
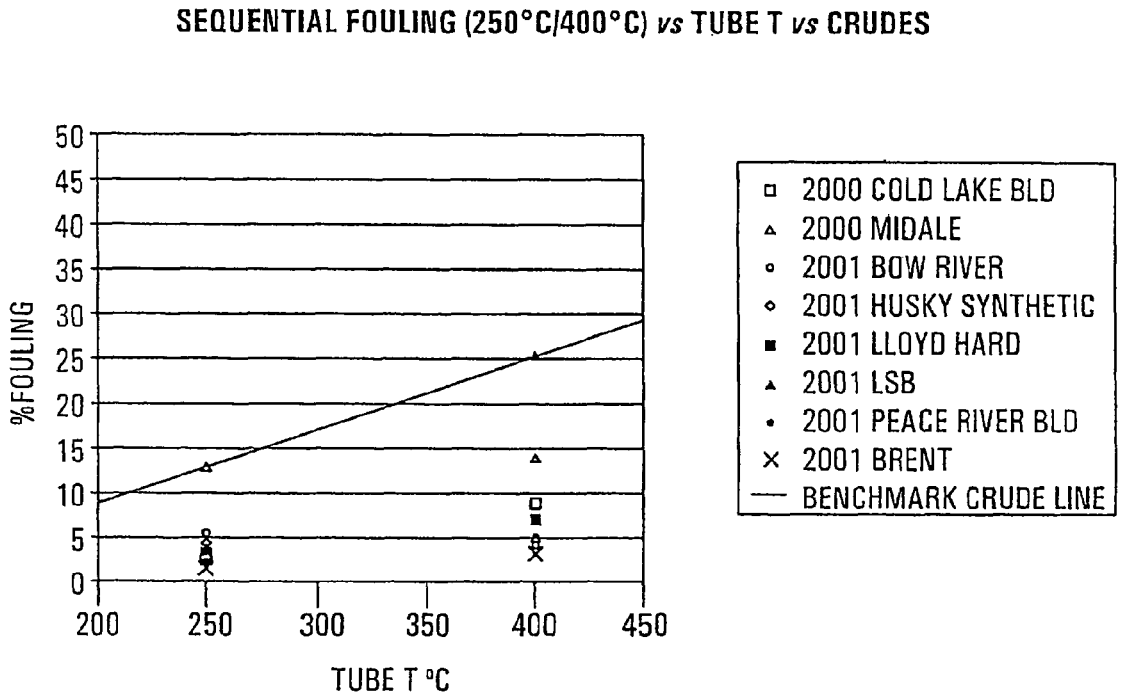
FIG. 3 illustrates a benchmark crude line obtained from an ALCOR Rig sequential temperature fouling test to determine the rank of an upgrader heavy residue containing crudes in comparison to conventional virgin crudes.

Heavy crudes tested: Lloyd Hardisty blend, Cold Lake blend, Peace River blend, Wabasca, and Bow River The benchmark crudes line in FIG. 3 is used in the current study to rank the various upgrader heavy crude blends such that:

PASS means below the line, among the band of conventional crudes;

FAIL means above the line, fouling more than conventional crudes.

Stability Levers

In order to meet the quality targets for stable pipelineable crudes using the testing protocol described above, the following two important blending parameters were found to be effective in controlling stability and fouling:

% virgin residue in the 524° C.+ fraction of the resultant final heavy crude. By definition, the unconverted or cracked residues come from the heavy oils of the reactor effluent separators and the virgin residues come from either the purchased heavy oil/diluted bitumen or vacuum residue bypass. Laboratory tests indicated that more than ⅓ of the 524° C.+ residue needs to be of virgin origin in order to keep the HFT below target of 0.15% wt and P-value >1. Also, the source of residue is very important as some diluted bitumens or heavy crudes are more effective than others in terms of both HFT and fouling results. Thus the % virgin residue required for some heavy crudes or bitumens would be higher than ⅓, more like in the range of 40-50% volume (see Examples in next section). On the other hand, some vacuum residue bypassingthe conversion unit to blending may help in reducing HFT.

But then again depending on the source, excessive amount of vacuum residue bypassing (>5% volume equivalent in the final heavy crude blend) was showing to cause new fouling issues. Thus the recipe of the final heavy crude blend must recognize the difference in origin of the virgin residues.

The 524° C.+ residue content in the final heavy crude blend should be in the range of 30-36% volume. This means that the final heavy crude blend cannot be too heavy or too light in terms of 524° C.+ content in order to pass the fouling criteria. In addition, laboratory trials were not successful so far in making blends with lesser residue content to meet HFT target of less than 0.15% wt.

The candidates for the commercially available blending component can be a heavy oil like Wabasca (a typical in-situ heavy oil) or a diluted bitumen from Peace River or Cold Lake (conventional in-situ produced bitumen). Some properties are listed below:

Wabasca summer sample: density=935 Kg/m$^3$, Visc @ 6*C=494 cSt, P-value=2.79, 35-37% Vol 524° C.+ residue, S=3.5% wt Peace River diluted bitumen blend: density=935 Kg/m$^3$, Visc @ 6*° C.=329 cSt, P-value=2.42, 35-37% Vol 524° C.+ residue, S=4.5% wt.

Cold Lake diluted bitumen summer blend: density=928 Kg/m$^3$, Visc @ 6*C=566 cSt, P-value=2.08, 35-38% vol 524° C.+, S=3.68% wt.

The effectiveness of these heavy oils and diluted bitumens in stabilizing upgrader unconverted residues to allow making stable pipelineable heavy crude blends will be illustrated in the following examples.

EXAMPLES

Several blend recipes have been tested in the laboratory and confirmed to pass the stability and fouling criteria. For illustration purpose, the present invention used as an example the Shell Scotford Upgrader based on LC-Fining at high conversion and a 9% wt C5 asphaltenes Athabasca bitumen feed to the Upgrader. This is a reduced asphaltene Athabasca bitumen obtained from a special froth treatment process. LC-Fining ebullated pilot plant programs were carried out using the vacuum residue under high temperatures and high pressures of hydrogen in the presence of a catalyst, to obtain products from different conversion levels for use in the blending program. A different Upgrader feed with higher C5 asphaltenes level was also tested to check the robustness of the invention. The heavy oils collected from the pilot plant runs were distilled to obtain the equivalent of a 427° C.+ heavy oil stripper bottoms (herein called "HOS Bottoms"). This HOS Bottoms contains the unconverted residues. The light oils (427° C. minus) were hydrotreated in a separate downstream pilot plant unit to remove sulphur and nitrogen. The hydrotreated light oils as well as some unhydrotreated ones were used as diluent to make up the final heavy crude blend for meeting pipeline viscosity and density requirements. The testing protocol was applied to assess the stability of the heavy crude blends and to scout for suitable blending components (i.e., commercially available Wabasca heavy oil or Peace River/Cold Lake diluted bitumens).

(a) Example 1

Without the addition of a commercially available heavy oil or diluted bitumen as blending component to stabilize the asphaltenes, the Upgrader heavy crude blends are not stable as illustrated by the key quality for 3 different levels of conversion in LC-Fining. The HFT is very high and the P-value is between borderline to unstable (<1). Please note the light oils used were a combination of hydrotreated and unhydrotreated materials.

| % volume of blending components | Heavy Crude Blend at 77% conversion | Heavy Crude Blend at 73% conversion | Heavy Crude Blend at 64% conversion | Heavy Crude Blend at 64% conversion |
|---|---|---|---|---|
| Sample ID | 3171 | 4111 | 3091 | 4171 |
| Light Oils | 38% vol | 38.5% vol | 38% vol | 34.5% vol |
| | unHT & HT | HT' ed | unHT & HT | unHT & HT |
| HOS Bottoms | 62% vol | 61.5% vol | 62% vol | 65.5% vol |
| TOTAL | 100% vol | 100% vol | 100% vol | 100% vol |
| Key Quality | | | | |
| Density, Kg/m$^3$ | 936 | 923 | 917 | 941 |
| Visc cSt at 6° C. | 272 | 245 | 201 | 429 |
| HFT, % wt | 0.36 | 0.20 | 0.24 | 0.29 |
| P-value | 1.00 | Unstable | 1.00 | Unstable |
| Fouling Tests | PASS | Not done | FAIL | FAIL |
| % vol 524° C.+ | 34 | 34 | 34 | 36 |
| % virgin 524° C.+ | 0 | 0 | 0 | 0 |

None of the final heavy crude blends produced in this example would be considered stable crudes.

(b) Example 2

This example illustrates the effectiveness of various heavy oils and diluted bitumens (i.e., source of virgin 524° C.+) to stabilize the asphaltenes from the Upgrader unconverted residues for the case of 77% conversion in LC-Fining. Also tested was a case with a vacuum residue LC-Fining feed bypass directly to blending (called SR bypass from a 9% wt C5 asphaltenes Athabasca bitumen). The light oils are a combination of hydrotreated and unhydrotreated materials.

ratio required is roughly 2 volumes of Upgrader materials to 1 volume of Peace River diluted bitumen to give ~34% of virgin Peace River 524° C.+ in the final heavy crude blend. If Wabasca were to be used, more quantity is needed (see column 3: ~37% of virgin Wabasca 524° C.+) than Peace River case. Thus, the blending ratio required is roughly 1.75 volumes of Upgrader materials to 1 volume of Wabasca heavy crude. Cold Lake is not as good as Wabasca (see column 4) and further test results are shown in Example 3. Bypassing some of the LC-Fining vacuum residue feed to blending the final heavy crude (equivalent to 11.5% v) and adding back more light oils (hydrotreated and unhydrotreated) is less

| % volume of blending components | Heavy Crude Blend @ 2:1 PR | Heavy Crude Blend @ 2:1 Wab | Heavy Crude Blend @ 1.75:1 Wab | Heavy Crude Blend @ 2:1 CL | Heavy Crude Blend with 12% SR Bypass |
|---|---|---|---|---|---|
| Sample ID | 3171/PR 2:1 | 3171/Wab 2:1 | 3171/Wab 1.75:1 | 3171/CL 2:1 | 3175 |
| Light Oils | 25.4% vol | 25.4% vol | 24.2% vol | 25.4% vol | 47.1 |
| | unHT and HT | unHT & HT | unHT & HT | unHT & HT | unHT & HT |
| HOS Bottoms | 41.3 | 41.3 | 39.4 | 41.3 | 41.4 |
| Peace River | 33.3 | 0 | 0 | 33.3 | 0 |
| Wabasca | 0 | 33.3 | 36.4 | 0 | 0 |
| Cold Lake | 0 | 0 | 0 | 0 | 0 |
| SR bypass | 0 | 0 | 0 | 0 | 11.5 |
| TOTAL | 100% vol | 100% vol | 100% vol | 100% vol | 100% vol |
| Key Quality | | | | | |
| Density, Kg/$^{m3}$ | 937 | 934 | 934 | 937 | 918 |
| Visc cSt at 6° C. | 298 | 276 | 274 | 358 | 111 |
| HFT, % wt | 0.04 | 0.07 | 0.04 | 0.08 | 0.19 |
| P-value | 1.17 | <1 | 1.04 | 1.12 | 1.03 |
| Fouling Tests | PASS | FAIL | PASS | FAIL | FAIL |
| % vol 524° C.+ | 34 | 34 | 34 | 35 | 34 |
| % virgin 524° C.+ | 34 | 34 | 37 | 36 | 34 |

It can be seen that Peace River diluted bitumen is more effective in helping to meet the stability targets than Wabasca and Cold Lake, as a blending component to stabilize the asphaltenes in the Upgrader heavy crude blend. The blending effective than the other options even though the % virgin 524° C.+ is in the same range as other cases.

(c) Example 3

Further optimization is illustrated here on the ratio required for heavy oil and diluted bitumens (i.e., source of virgin 524° C.+) to stabilize the asphaltenes from the Upgrader unconverted residues for the case of 77% conversion in LC-Fining.

It should be noted that the light oils in this example were a combination of hydrotreated materials only, thus leading to slightly more Wabasca required than in Example 2. In this example, the blending ratio would be 1.65 volumes of Upgrader materials to 1 volume of Wabasca.

Example 2), it can still be used to trade off some volume of purchased heavy oil/diluted bitumen for blending when there is excess feed to LC-Fining. This is illustrated here for the case of 77% conversion in LC-Fining. The light oils in this example were a combination of hydrotreated materials only.

| % volume of blending components. | Heavy Crude Blend @ 1.65:1 Wab | Heavy Crude Blend @ 1.65:1 CL | Heavy Crude Blend @ 1:1 CL | Heavy Crude Blend @ 1.75:1 of Wab75/PR25 | Heavy Crude Blend @ 1.65:1 of Wab60/CL40 |
|---|---|---|---|---|---|
| Sample ID | 4146 | 4147 | 41471 | 41411B | 41481 |
| Light Oils | 25.2% vol HT' ed | 25.2% vol HT' ed | 20.3% vol HT' ed | 25.8% vol HT' ed | 25.2% vol HT' ed |
| HOS Bottoms | 37.0 | 37 | 29.7 | 37.8 | 37 |
| Peace River diluted bitumen | 0 | 0 | 0 | 9.1 | 0 |
| Wabasca | 37.8 | 0 | 0 | 27.3 | 22.7 |
| Cold Lake diluted bitumen | 0 | 37.8 | 50 | 0 | 15.1 |
| TOTAL | 100% vol | 100% vol | 100% vol | 100% vol | 100% vol |
| Key Quality | | | | | |
| Density, Kg/m$^3$ | 939 | 941 | 935 | 940 | 940 |
| Visc cSt at 6° C. | 349 | 488 | 362 | 350 | 372 |
| HFT, % wt | 0.04 | 0.04 | 0.02 | 0.11 | 0.04 |
| P-value | 1.02 | 1.07 | 1.34 | 1.04 | 1.15 |
| Fouling Tests | PASS | FAIL | PASS | PASS | PASS |
| % vol 524° C.+ | 33 | 34 | 34 | 33 | 34 |
| % virgin 524° C.+ | 40 | 40 | 52 | 38 | 40 |

It can be seen that Cold Lake diluted bitumen is the least effective (needing ~50%+ of virgin Cold Lake 524° C.+) in helping to meet the stability targets among the 3 candidates as a blending component to stabilize the asphaltenes in the Upgrader heavy crude blend. The blending ratio required is roughly 1 volume of Upgrader materials to 1 volume of Cold Lake diluted bitumen. The blending ratios are also illustrated where a combination of Wabasca/Peace River and Wabasca/Cold Lake were used as blending components instead of single candidate. It can be seen that Peace River helps to reduce the quantity of purchase required: 1.75 volumes of Upgrader materials to 1 volume of a combination 75/25 Wabasca/Peace River (compared 1.65:1 with Wabasca alone). Even though Cold Lake alone is not as effective, some Wabasca can compensate as shown in column 5 compared to columns 2 & 3. This protocol can be used to find the appropriate ratio if all 3 candidates were used together (e.g., a final heavy crude blend consisting of 1.65 volumes of Upgrader materials to 1 volume of a combination of 50/25/25 Wab/PR/CL would produce a stable pipelineable crude).

(d) Example 4

Although the SR bypassing of LC-Fining feed to blending by itself doesn't work very well (as shown in column 5 of

| % volume of blending components | Heavy Crude Blend with 5% SR bypass & 3:1 Wab | Heavy Crude Blend with 5% SR bypass & 3:1 of Wab70/CL30 | Heavy Crude Blend with 5% SR bypass & 2:1 CL |
|---|---|---|---|
| Sample ID | 4203 | 41414 | 41415 |
| Light Oils | 31.7% vol HT' ed | 31.7% vol HT' ed | 28.7% vol HT' ed |
| HOS Bottoms | 37.8 | 37.8 | 33.3 |
| Peace River diluted bitumen | 0 | 0 | 0 |
| Wabasca | 25.5 | 17.9 | 0 |
| Cold Lake diluted bitumen | 0 | 7.7 | 33 |
| SR bypass | 5 | 5 | 5 |
| TOTAL | 100% vol | 100% vol | 100% vol |
| Key Quality | | | |
| Density, Kg/m$^3$ | 935 | 940 | 940 |
| Visc cSt 6° C. | 357 | 393 | 465 |
| HFT, % wt | 0.02 | 0.03 | 0.02 |
| P-value | 1.30 | 1.09 | 1.33 |
| Fouling Tests | PASS | PASS | PASS |
| % vol 524° C.+ | 33 | 35 | 35 |
| % virgin 524° C.+ | 40 | 40 | 48 |

Compared to Example 3, less Wabasca or Cold Lake diluted bitumen would be required to purchase as blending components if there is some excess SR bypass that can routed directly to blending by keeping roughly the same % of virgin 524° C.+ in the final heavy crude blends. Thus, with some 5% equivalent internal SR bypass, the blending ratio would be 3 volumes of Upgrader materials to 1 volume of Wabasca heavy oil. Similar reduction of requirement is seen with Cold Lake with some 5% equivalent internal SR bypass. However, it is not recommended to use more than 5% equivalent SR bypass as excessive amount would cause fouling issue as seen in column 5 of Example 2.

(e) Example 5

The blending exercise was demonstrated with lower conversion LC-Fining unconverted residues. The results are shown below. The light oils in this example were a combination of hydrotreated materials only.

| % vol. of blending components | Heavy Crude Blend at 65% conversion and 2.4:1 Wab | Heavy Crude Blend at 73% conversion and 2:1 Wab | Heavy Crude Blend at 73% conversion with 5% SR bypass & 4:1 Wab |
|---|---|---|---|
| Sample ID | 4172 | 4116 | 41162 |
| Light Oils | 27.7% vol unHT & HT | 26.41 HT' ed | 33.2% vol HT' ed |
| HOS Bottoms | 43.2 | 40.1 | 41.8 |
| Peace River diluted bitumen | 0 | 0 | 0 |
| Wabasca | 29.2 | 33.5 | 20 |
| Cold Lake diluted bitumen | 0 | 0 | 0 |
| SR bypass | 0 | 0 | 5 |
| TOTAL | 100% vol | 100% vol | 100% vol |
| Key Quality | | | |
| Density, Kg/m$^3$ | 937 | 926 | 925 |
| Visc, cSt 6° C. | 463 | 256 | 249 |
| HFT, % wt | 0.03 | 0.01 | 0.02 |
| P-value | 1.14 | 1.43 | 1.43 |
| Fouling Tests | PASS | PASS | PASS |
| % vol 524° C.+ | 33 | 35 | 35 |
| % virgin 524° C.+ | 30 | 35 | 35 |

It can be seen that lowering conversion would alleviate somewhat (less % virgin 524° C.+ required) but does not eliminate the stability issue (see also Example 1). Thus less blending components (heavy oil or diluted bitumen) are needed. At 65% conversion in LC-Fining, only 30% of virgin Wabasca 524° C.+ is needed compared to 40% at 77% conversion in LC-Fining. Thus the blending ratio at 65% conversion would be 2.4 volumes of Upgrader materials to 1 volume of Wabasca. At 73% conversion, the ratio would be 2 volumes of Upgrader materials to 1 volume of Wabasca. If there were some 5% equivalent internal SR bypass, at 73% conversion the blending ratio would be 4 volumes of Upgrader materials to 1 volume of Wabasca.

(f) Example 6

This example illustrates that the purchased heavy oil or diluted bitumen blending component concept can also be applied to other feedstocks to the Upgrader. In this case, Cold Lake diluted bitumen was used as an alternate feed to the Upgrader. The achievable conversion level in LC-Fining with Cold Lake is lower and the results of the blending exercise are shown below. The light oils in this example were a combination of hydrotreated materials only.

| % volume of blending components | Heavy Crude Blend at 60% conversion | Heavy Crude Blend at 60% conv & 2.4:1 CL | Heavy Crude Blend at 60% conv & 3.5:1 Wab |
|---|---|---|---|
| Sample ID | 50911 | 50972 | 50963 |
| Light Oils | 39.1% vol HT' ed | 27.7% vol HT' ed | 30.5% vol HT' ed |
| HOS Bottoms | 60.9 | 42.1 | 47.3 |
| Peace River diluted bitumen | 0 | 0 | 0 |
| Wabasca | 0 | 0 | 22.2 |
| Cold Lake diluted bitumen | 0 | 29.2 | 0 |
| TOTAL | 100% vol | 100% vol | 100% vol |
| Key Quality | | | |
| Density, Kg/m$^3$ | 917 | 921 | 921 |
| Visc cSt 6° C. | 240 | 257 | 240 |
| HFT, % wt | 0.70 | 0.08 | 0.04 |
| P-value | Unstable | 1.18 | 1.20 |
| Fouling Tests | FAIL | PASS | PASS |
| % vol 524° C.+ | 33 | 34 | 34 |
| % virgin 524° C.+ | 0 | 30 | 23 |

The concept and protocol works equally well with another feedstock to the Upgrader, to find the most effective heavy oil or diluted bitumen as blending component to help stabilize the asphaltenes in the final heavy crude blend. It can be seen that the lower conversion and this feedstock type requires less purchased heavy oil or diluted bitumen blending component than Example 5. Also, Wabasca crude oil is again shown to be more effective than Cold Lake bitumen as candidate blending component.

We claim:

1. A method of blending a heavy hydrocarbon residue from a residue hydroconversion process into a pipelineable blend, the method comprising blending the heavy hydrocarbon residue with a virgin bitumen diluted with a diluent and/or a virgin heavy crude oil such that in the produced blend the amount of heavy hydrocarbon residue originating from said residue hydroconversion process is maintained below a predetermined maximum value, wherein the heavy hydrocarbon residue stems from a high conversion catalytic hydroconversion process, operating at a 60-80% conversion rate of the 524° C.+ fraction, that the blending comprises controlling the composition of the heavy 524° C.+ component in the blend such that the blend comprises less than 36 and greater than 30 vol % of heavy 524° C.+ components, which boil at atmospheric pressure at a temperature about 524° C. and that the ratio between the unconverted heavy 524° C.+ components contained in the heavy hydrocarbon residue and the virgin 524° C.+ components contained in the virgin bitumen diluted with diluent and/or virgin heavy crude oil is such that the heavy 524° C.+ heavy hydrocarbon blend comprises between 45 to 75 vol % unconverted heavy 524° C.+ hydrocarbon residue originating from the residue hydroconversion process and the pipelineable blend has a P factor greater than 1, a hot filtration test, according to ASTM D4870, less than 0.15% by weight, and a fouling test result of less than 25% at 400° C.

2. The method of claim 1, wherein the blending comprises controlling the ratio between the unconverted heavy 524° C.+ component contained in the heavy hydrocarbon residue and the virgin 524° C.+ component contained in the virgin bitumen diluted with diluent and/or virgin heavy crude oil such that the heavy 524° C.+ component in the blend comprises between 45 vol % and 75 vol % unconverted heavy 524° C.+ hydrocarbon residue originating from the residue hydroconversion process.

3. The method of claim 1, wherein the blend comprises a virgin heavy crude oil and/or a virgin bitumen diluted with hydrocarbon condensate as a diluent.

4. The method of claim 3, wherein the blend comprises virgin bitumen originating from the Peace River and/or Cold Lake oil sand deposits in Canada and/or a virgin heavy crude oil originating from the Wabasca oil field in Canada.

5. The method of claim 1, wherein the blend ratio between the unconverted heavy hydrocarbon residue and the virgin bitumen diluted with a diluent and/or virgin crude oil is determined on the basis of test protocols, such as test protocols known as the ASTM hot filtration test, the P-Value test and the fouling test.

6. The method of claim 1, wherein the method is used to produce stable blends with stabilized asphaltenes that are transportable through long distance onshore or offshore pipelines in cold climates having a length more than 100 kilometers.

7. The method of claim 1, wherein the blend comprises up to 5 vol % of bypass of an LC-Fining feed.

8. A pipelineable blend obtainable by the method according to claim 1, the blend comprising less than 36 and greater than 30 vol % of heavy 524° C.+ components and said heavy 524° C.+ components comprise between 45 to 75 vol % of heavy 524° C.+ hydrocarbon residue originating from a hydroconversion process and the pipelineable blend has a P factor greater than 1, a hot filtration test, according to ASTM D4870, less than 0.15% by weight, and a fouling test result of less than 25% at 400° C.

* * * * *